US005900341A

United States Patent [19]

Weiss et al.

[11] Patent Number: 5,900,341

[45] Date of Patent: May 4, 1999

[54] PROCESS FOR THE FORMATION OF IMAGES ON PRINTING FORM HAVING FERROELECTRIC MATERIAL LAYER

[75] Inventors: Robert Weiss, Gersthofen; Alfred Hirt, München, both of Germany

[73] Assignee: MAN Roland Druckmaschinen AG, Offenbach AM Main, Germany

[21] Appl. No.: 08/922,742

[22] Filed: Sep. 3, 1997

Related U.S. Application Data

[63] Continuation of application No. 08/533,767, Sep. 26, 1995, abandoned.

[30] Foreign Application Priority Data

Sep. 29, 1994 [DE] Germany ..... 44 34 766

[51] Int. Cl.[6] ..... G03G 13/056

[52] U.S. Cl. ..... 430/49; 430/51

[58] Field of Search ..... 430/51, 49, 31

[56] References Cited

U.S. PATENT DOCUMENTS

| | | | |
|---|---|---|---|
| 3,700,436 | 10/1972 | Grier | 430/51 |
| 3,899,969 | 8/1975 | Taylor . | |
| 3,928,031 | 12/1975 | Kinoshita | 430/51 |
| 3,989,364 | 11/1976 | Kawakami et al. | 430/51 |
| 4,413,044 | 11/1983 | Nishikawa . | |

FOREIGN PATENT DOCUMENTS

| | | |
|---|---|---|
| 1 957 991 | 6/1970 | Germany . |
| 2530290 | 1/1976 | Germany . |
| 57-202546 | 12/1982 | Japan . |
| 58-139561 | 8/1983 | Japan . |
| 63-220178 | 9/1988 | Japan . |
| 03296769 | 12/1991 | Japan . |
| 5 224 491 | 3/1993 | Japan . |

OTHER PUBLICATIONS

"Electrophotography", Shaffert, The Focal Press, 1975, pp. 5–12,24,25 and 94–104.

Grant, Roger & Claire Grant. Grant & Hackh's Chemical Dictionary. New York: McGraw–Hill, Inc. p. 232, 1987.

*Primary Examiner*—Christopher D. Rodee
*Attorney, Agent, or Firm*—Cohen, Pontani, Lieberman & Pavane

[57] ABSTRACT

A printing form and process relating to the formation of images on the printing form. The printing form includes a ferroelectric layer (1) on which photoferroelectric effect is used to polarize or depolarize the layer to form the image to be printed in the layer (1). The printing form may also include a layer which is neither ferroelectric nor has the function of a photoconductor which adjoins the ferroelectric layer 1. In this instance, the photoelectric effect is used to form the image to be printed on the ferroelectric layer.

13 Claims, 2 Drawing Sheets

PROCESS FOR THE FORMATION OF IMAGES ON PRINTING FORM HAVING FERROELECTRIC MATERIAL LAYER

This is a continuation of application Ser. No. 08/533,767, filed Sep. 26, 1995, abandoned.

BACKGROUND OF THE INVENTION

1. Field of the Invention

The present invention relates to a process of forming images on a printing form and, more particularly, to a process of forming images on a printing form wherein the printing form includes a first layer containing a ferroelectric material exhibiting the photoelectric effect, i.e. the photoferroelectric effect. Free charge carriers are generated in the ferroelectric material by irradiation with light above the photoelectric threshold frequency of the ferroelectric material. The free charge carriers may also be generated by the photoelectric effect in a nonferroelectric layer adjoining the ferroelectric layer on which images are to be formed, this layer being solely a charge-generating layer of a photoconductor formed of a plurality of layers and is therefore not a photoconductor in the conventional sense. Further, the invention is directed to a printing form including a ferroelectric layer especially designed to enhance the photoferroelectric effect.

2. Description of the Prior Art

A printing form which is constructed as a thin disk or plate with a ferroelectric material and a photoconductive coating on one of its surfaces is known from German Patent Application DT 25 30 290 A1. A first electrode is arranged surfacewise below the ferroelectric material and a second electrode is applied to the photoconductive coating. The photoelectric layer acts as a switch. At least one of the two electrodes is removable and at least the electrode on the photoconductive coating is transparent to light. If an optical image is focussed on the photoconductive coating of the printing form and an electric voltage is applied to the two electrodes at the same time, the ferroelectric material can be polarized imagewise. Instead of beaming the image onto the surface of the printing form with a master image and by focussing light the surface of the printing form can also be scanned by a focussed light beam, e.g. a laser beam. If a d.c. voltage is applied to the two electrodes at the same time, the specific electric resistance of the photoconductive coating decreases in the light regions on the photoconductive surface, i.e. in the regions exposed imagewise. Therefore, the d.c. voltage acts principally on those regions of the ferroelectric material which lie below the light image regions of the photoconductive coating. The specific resistance of the photoconductive coating remains high in the dark image regions. Accordingly, a ferroelectric polarization is induced in the ferroelectric material only in those regions corresponding to the light image regions.

A printing process using a pyroelectric film is known from U.S. Pat. No. 3,899,969. Ferroelectric materials, e.g. lead-zirconate-titanite or polyvinylidene fluoride, are also used for this pyroelectric film. A ferroelectric material of this type is introduced, for example, between two surfacewise electrodes, one of which is transparent to light. A voltage is applied between the two electrodes and the ferroelectric film is selectively heated by electromagnetic radiation in accordance with an image pattern to be formed on it. The ferroelectric material is permanently polarized in accordance with the image by surfacewise application of the electric field and by selective heating. The cumbersome photothermal effect which is not always controllable is used for this purpose.

SUMMARY OF THE INVENTION

It is accordingly an object of the present invention to provide a process by which images can be formed on ferroelectric printing forms using an optical control and reducing the magnitude of the coercive field of the printing form on which an image is formed by this process.

The present invention makes use of the photoelectric effect, i.e. the photoferroelectric effect, in a ferroelectric layer. Instead of the photoferroelectric effect, it is also possible to make use of the photoelectric effect in a layer which adjoins a ferroelectric material, but which, in contrast to the photoconductive layers known from German Patent Application DT 25 30 290 A1, comprises only a functional component of such a photoconductive layer and is not capable of functioning as a photoconductor by itself.

Whereas the photoelectric effect, i.e. especially the photoferroelectric effect, only occurs when the irradiated light has sufficient energy, that is, when it has exceeded a determined threshold frequency, every type of electromagnetic irradiation of the ferroelectric material, even when its energy is not sufficient to produce the photoferroelectric effect, causes a heating effect in the ferroelectric material due to the absorption of this radiation which effect as is already known from U.S. Pat. No. 3,899,969. Accordingly, for the purpose of forming images, a ferroelectric material can be irradiated not only by light which exceeds the threshold frequency, but also by light having other frequencies, e.g. lower frequencies, in order to support the polarization of the ferroelectric material by increasing the temperature of the ferroelectric material, i.e. through the photothermal effect.

Further, the present invention relates to printing forms on which an image can be formed by the photoferroelectric effect.

The invention is explained more fully in the following embodiment examples with reference to the drawings.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings in which like numerals denote like elements.

DETAILED DESCRIPTION OF THE PRESENTLY PREFERRED EMBODIMENT

Figure 1:
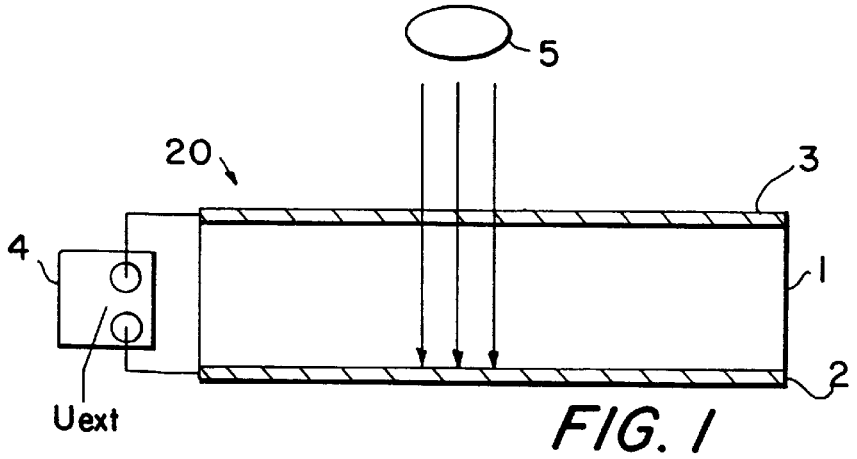
FIG. 1 shows a printing form having a ferroelectric layer covered by electrodes on both sides.

FIG. 1 shows a printing form in accordance with the present invention and labelled generally by the numeral 20.

The printing form 20 includes a ferroelectric layer 1 which may be formed of lead-zirconate-titanite (PZT), lead-lanthanum-zirconate-titanite (PLZT), or any ceramic containing a ferroelectric material.

The ferroelectric layer 1 is covered over the entire surface of its lower side by an electrode 2. The upper side of the ferroelectric layer 1 is likewise covered over the entire surface by a removable electrode 3 which is transparent to light. For example, the electrode 3 may be a transparent sheet coated with indium oxide ($In_2O_3$) or tin oxide ($SnO_2$). A voltage source 4 is provided for generating an external voltage $U_{ext}$ and applying the voltage between the electrodes 2 and 3. The layer 1 is irradiated by light, e.g. near-UV light, from a light source 5 through the light-transparent electrode 3. This light has sufficient energy, i.e. its frequency lies above a threshold frequency specific to the ferroelectric material in question, to bring about the photoelectric effect (photoferroelectric effect) in the ferroelectric material of the ferroelectric layer 1.

The photoferroelectric effect is based on the same physical principle as the photoelectric effect in pn junctions of semiconductors. In these semiconductors an electric field is applied to produce a zone called a barrier or depletion layer which is free of charge carriers in the pn junction by causing diffusion of excess charge carriers.

In a polarized ferroelectric material, a comparable depletion layer forms at both surfaces due to an electric field applied between the oriented domains and the polarizing charge required for shielding the electric field. When light is absorbed by this surface layer, free charge carriers are generated.

When an external electric field $U_{ext}$ is applied at the same time between the electrodes 2 and 3 by voltage source 4, the charge carriers move in accordance with the effect of the external electric field and produce a stable, permanent space charge field. The strength of this field is dependent on the number of charge carriers generated by the photoelectric effect and therefore on the duration and intensity of irradiation, assuming that the threshold frequency for the photoelectric effect is exceeded. The space charge field is superimposed on the applied field and assists in polarizing the ferroelectric material, i.e. the coercive field strength needed for the reorientation of the ferroelectric domains is reduced by the space charge field.

An electric field whose strength lies below the coercive field strength ($E_c$) of the layer 1 is now applied between the electrodes 2 and 3 by the voltage source 4. This means that the field strength of the electric field applied by the voltage source 4 is not sufficient by itself to polarize the ferroelectric material in the layer 1. The coercive field strength decreases to a value $E_c'$ below the field strength of the electric field present between the electrodes 2 and 3 only when the layer 1 is irradiated imagewise by the light source 5. The strength of the electric field E applied between the electrodes 2 and 3 is therefore smaller than the coercive field strength $E_c$ of the layer 1 when it is not irradiated, but greater than the coercive field strength $E_c'$ of the layer 1 when it is irradiated. The electrode 3 is removed after the formation of the image by irradiation. The printing form is now ready to be used for printing an optional number of copies by means of charged toner particles attracted by locations which are polarized in accordance with the image.

Figure 2:
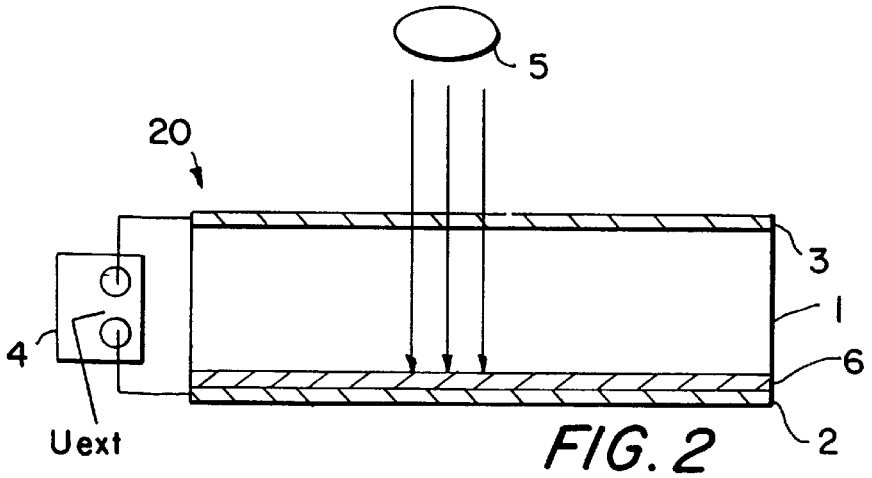
FIG. 2 shows the printing form of FIG. 1 including an additional ferroelectric layer.

FIG. 2 shows another printing form including an additional layer 6 containing a ferroelectric material. The ferroelectric material for the layer 6 is selected in such a way that its coercive field is of a magnitude greater than the coercive field of layer 1. Therefore, when an electric field whose magnitude lies above the magnitude of the coercive field of layer 1, but below the magnitude of the coercive field of layer 6, is applied between the electrodes 2 and 3 by the voltage source 4, this layer 6 acts as an insulator and prevents polarization until the printing form is irradiated by light. It is only when the layer 6 is irradiated by light whose frequency lies above the threshold frequency for the photoelectric effect of the ferroelectric material in the layer 6 that this layer 6 becomes electrically conductive or capable of polarization in accordance with the process shown in FIG. 1 and also permits layer 1 to be polarized. The printing form can then be exposed imagewise by the light source 5, provided that the layer 1 is transparent for light of this frequency.

Figure 3:
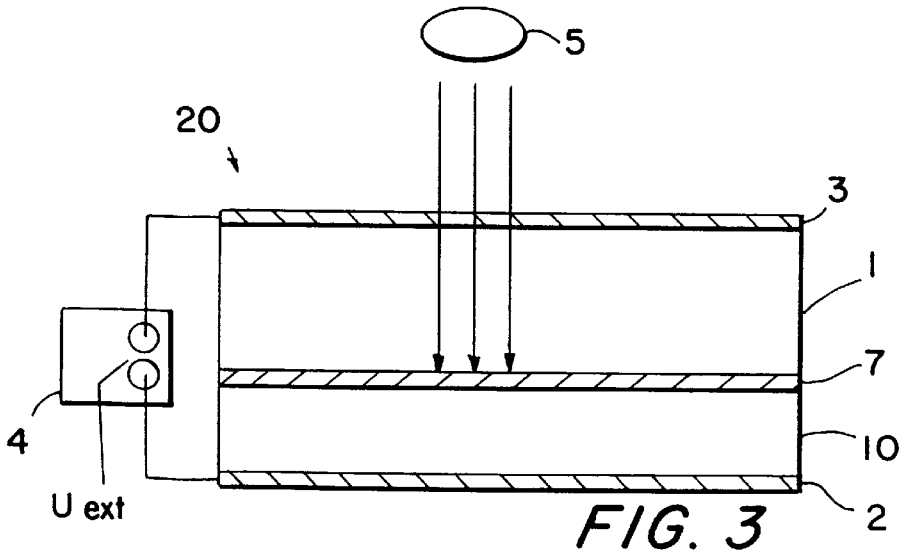
FIG. 3 shows the printing form of FIG. 1 including a charge generator layer.

FIG. 3 shows a printing form wherein the underside of the ferroelectric layer 1 is covered by a charge generator layer 7 instead of by the electrode 2. Such layers are known from organic multilayer photoconductors (multilayer OPC) which are generally formed of a very thin charge generator layer and a relatively thick charge transport layer. In this way, prior to recombination, the greatest possible number of charge carriers generated by the photoelectric effect will be drawn into the transport layer which is not susceptible to recombination. In the ferroelectric material, this charge transport layer is the carrier-free zone directly adjoining the surface. When the layer 7 is irradiated imagewise by the light source 5 with light having a frequency which is sufficient to bring about the photoelectric effect in the layer 7, charge carriers are generated in layer 7, provided that layer 1 is transparent to this light. When the electrode 3 is at a determined potential relative to electrode 2, the free charge carriers generated in layer 7 move in the direction of the electrode 3 and into layer 1 due to the voltage applied between electrodes 2 and 3. A carrier layer 10 lies between the electrode 2 and the layer 7. The magnitude of the electric field is dependent on the number of generated charge carriers and on the potential between electrode 3 and electrode 2. If the magnitude of the electric field occurring in this way exceeds the magnitude of the coercive field of layer 1, this layer 1 is polarized imagewise. It is particularly advantageous if the frequency required for the photoelectric effect in layer 7 is above the threshold frequency required for the photoferroelectric effect in layer 1 since, in this way, the photoelectric effect in layer 7 is reinforced by the photoferroelectric effect in layer 1. When the printing form is irradiated directly on layer 7 from below, rather than from above through the electrode 3 and layer 1, the ferroelectric layer 1 can likewise be polarized. In this case, the layer 1 and the electrode 3 need not be transparent to light.

A plurality of ferroelectric layers exhibiting the photoferroelectric effect can be provided instead of an individual layer 1 for the embodiments described with reference to FIGS. 1–3. There can also be additional ferroelectric layers which do not exhibit the photoferroelectric effect, with respect to at least the frequency of the radiated light. The ferroelectric layer may have a multilayer construction, for example, as is known, per se, in photoelectric elements. The layers can be selected in such a way that a first layer has a strong photoferroelectric effect for the radiated light and another layer exhibits a high conductivity for the electrons generated from the first layer or has favorable polarization characteristics.

Layer 1 need not necessarily be transparent to light. In order to generate free electrons the photons may also be absorbed in the region lying directly below the electrode 3 or, provided the layer is irradiated from below and electrode 2 is transparent to light, in the region above the electrode 2.

Figure 4:
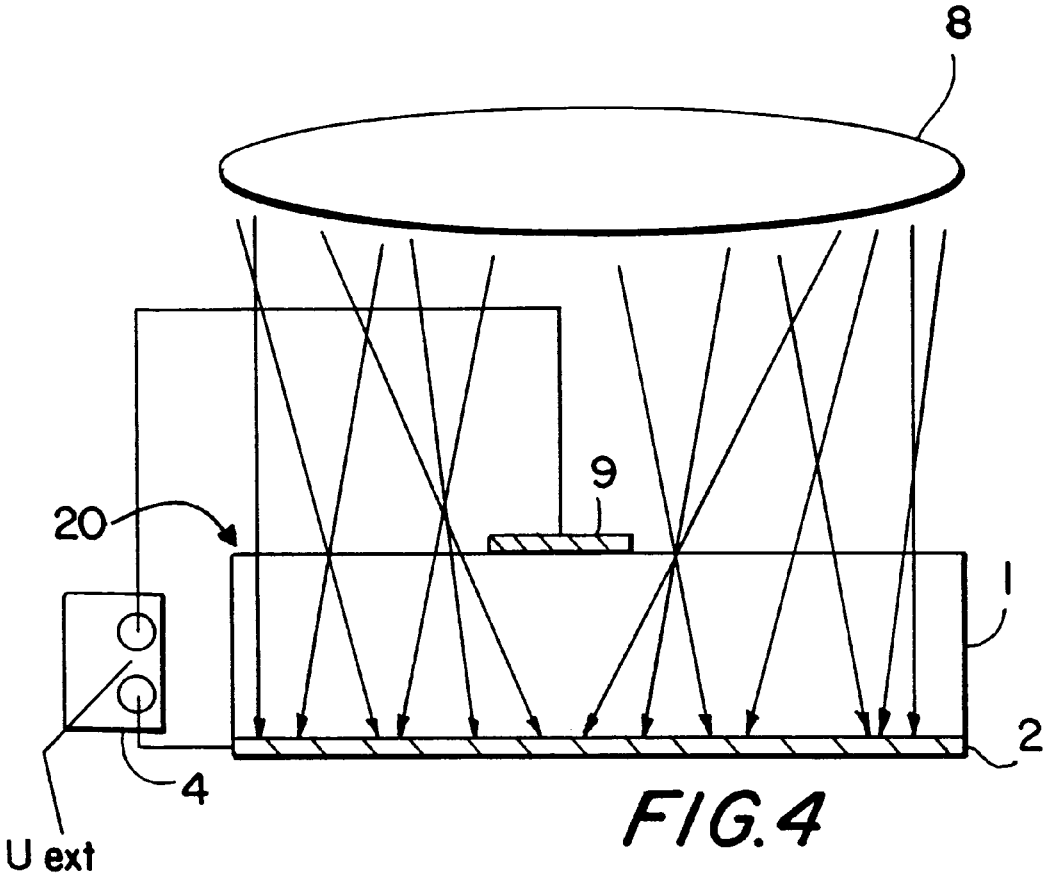
FIG. 4 shows the printing form of FIG. 1 including an image-forming electrode replacing one of the electrodes.

FIG. 4 shows a printing form in which the ferroelectric layer 1 and the electrode 2 covering the ferroelectric layer 1 are irradiated over their entire surface by a light source 8. A transparent image-forming electrode 9 lies on the upper side of layer 1 during the irradiation by the light source 8. A voltage $U_{ext}$ is applied by the voltage source 4 between the electrode 2 and the image-forming electrode 9. As a result of the irradiation of layer 1 along its entire surface, the magnitude of the coercive field in layer 1 is reduced due to the photoferroelectric effect so that the magnitude of the field required for polarization and accordingly the voltage $U_{ext}$ needed to be generated by the voltage source 4 is also reduced. In an image-forming device having a plurality of image-forming electrodes 9 arranged adjacent one another in order to achieve a corresponding resolution in the formation of the image, the risk of electric flashover between the individual imaging electrodes 9 is reduced due to the low voltage needed to produce the field required for polarization. A higher image resolution can be achieved in that the image-forming electrodes 9 can be brought together on a smaller surface at lower voltage.

Figure 5:
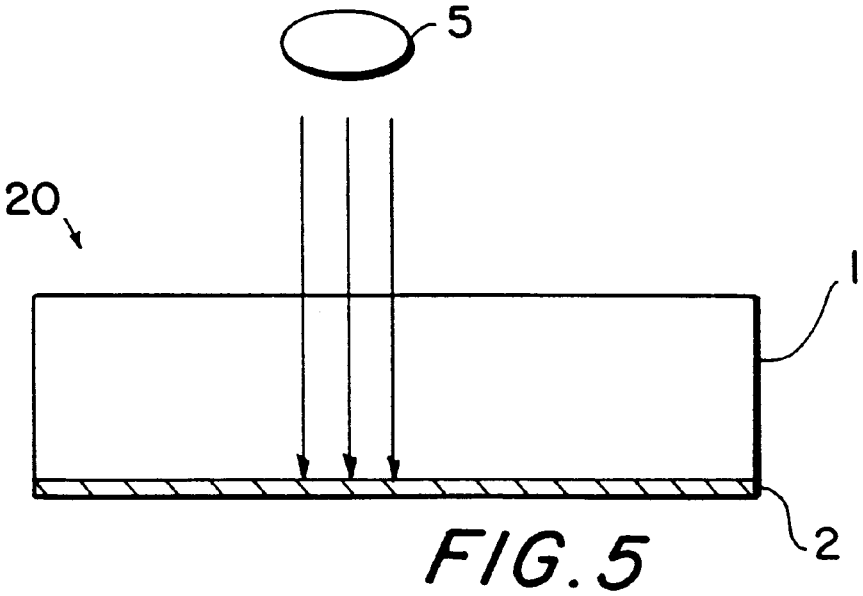
FIG. 5 shows the printing form of FIG. 1 wherein one of the electrodes has been removed.

FIG. 5 shows another printing form which is first polarized over its entire surface by applying a voltage $U_{ext}$ between the electrode 2 and the removable electrode 3 (not shown in FIG. 5). After removing the electrode 3, the printing form is irradiated in accordance with the image in such a way that a sufficiently high conductivity occurs along the entire thickness of the polarized layer 1, i.e. the photoferroelectric effect is made use of in that the layer 1 is irradiated with light above the threshold frequency required for this effect. For this purpose, the layer 1 must be thin enough that the charge carriers generated within it can move from the upper boundary layer to the lower boundary layer before recombination takes place. Accordingly, the layer 1 is sufficiently conductive so that the free charges on its surface which were generated during polarization flow through the layer 1 to the electrode 2. In a corresponding manner, the printing form is depolarized in accordance with the image at the locations irradiated by the radiation source 5. In contrast to the embodiment examples shown in FIGS. 1 to 4, a negative image is formed.

In the embodiment examples shown in FIGS. 1, 2, 4 and 5, the photothermal effect, as it is known per se, assists in forming the image in that the radiation source 5, 8 also emits low-energy light in addition to light of sufficient energy required for the photoferroelectric effect, the layer 1 being heated by this low-energy light.

The threshold energy of the radiation required for the photoelectric effect can be reduced by implanting foreign atoms in the depletion layer. For example, the photosensitivity can be shifted extensively in the visible region by prior implantation of chemically inert or noble gas ions (neon, helium or argon ions) in combination with chemically active ions such as aluminum or chromium ions in the layer 1 at least on the side from which the light penetrates it.

The invention provides a printing form with a ferroelectric layer 1 in which the formation of images on the layer 1 is supported by polarization or depolarization utilizing the photoferroelectric effect in the layer 1 or the photoelectric effect in a layer 7 which adjoins the layer 1, but which is neither ferroelectric nor has the function of a photoconductor.

In each of the embodiments depicted the transparent electrode may be replaced by a dielectric platelet including charge carriers. These charge carriers may be applied to the dielectric platelet prior to positioning on the ferroelectric layer 1 in any known manner including placement by corona discharge.

The invention is not limited by the embodiments described above which are presented as examples only but can be modified in various ways within the scope of protection defined by the appended patent claims.

We claim:

1. A process of forming images on a printing form comprising a first layer of ferroelectric material having a threshold frequency for triggering the photoelectric effect comprising the steps of:

positioning said first layer between a first electrode covering an entire side surface of the first layer and a light-transparent image forming electrode arranged on at least a portion of an opposite side surface of the first layer;

applying an electric field between the electrodes that is of a magnitude less than a coercive field strength of the non-irradiated first layer;

irradiating a portion of the first layer from the opposite side surface through the light-transparent electrode with light radiation of a frequency above the threshold frequency for initiating the photoelectric effect in the first layer, which generates charge carriers from the first layer;

polarizing the printing form in accordance with the image to be formed with the charge carriers generated by the photoelectric effect; and removing the light-transparent electrode from the opposite side surface of the first layer whereby the first layer is now ready for printing.

2. The process of claim 1, wherein said step of polarizing includes a second step of irradiating the first layer in accordance with the image to be formed.

3. The process of claim 1, wherein the step of irradiating also irradiates a charge generator layer positioned on a side of the first layer opposite a source of the radiation.

4. The process of claim 1, further comprising a further step of irradiating said first layer with electromagnetic radiation having a frequency below the threshold frequency of said first layer; and increasing the temperature of the first layer upon irradiation of the first layer with the electromagnetic radiation.

5. The process of claim 1, wherein said step of irradiating irradiates light imagewise through said second electrode and on said first layer at the same time said electric field is applied.

6. The process of claim 1, wherein the light-transparent image forming electrode is a dielectric platelet including charge carriers, said step of irradiating irradiates light imagewise through said dielectric platelet and on said first layer at the same time the electric field is applied.

7. The process of claim 6, further comprising the step of applying said charge carriers to said dielectric platelet prior to positioning on said first layer by corona discharge.

8. The process of claim 1, wherein the light-transparent image forming electrode is a dielectric platelet including charge carriers, and further comprising the step of arranging an additional ferroelectric layer between the first layer and the first electrode, a magnitude of a coercive field of the additional ferroelectric being greater than a coercive field of the first layer, applying the electric field between said dielectric platelet and said first electrode, and wherein said step of irradiating includes the steps of:

irradiating said dielectric platelet, first layer and additional ferroelectric layer with light above a threshold frequency of said additional ferroelectric layer; and generating free charge carriers in said ferroelectric layer causing said additional ferroelectric layer to become conductive, the applied electric field having a magnitude less than the coercive field strength of the first layer when not irradiated and greater than the coercive field strength of the additional ferroelectric layer to polarize said first layer when the additional ferroelectric layer becomes conductive.

9. The process of claim 8, further comprising the step of applying said charge carriers to said dielectric platelet prior to positioning on said first layer by corona discharge.

10. The process of claim 1, wherein the light-transparent image forming electrode is at least one dielectric platelet including charge carriers, and applying the electric field between said first electrode and said at least one dielectric platelet to generate an electric field in said first layer of a magnitude below a coercive field of the first layer, wherein said step of irradiating irradiates the surface of the first layer causing said electric field to exceed the magnitude of said coercive field and polarize said first layer in accordance with said image to be printed.

11. The process of claim 10, further comprising the step of applying said charge carriers to said dielectric platelet prior to positioning on said first layer by corona discharge.

12. The process of claim 1, wherein the light-transparent image forming electrode is a dielectric platelet including charge carriers and further comprising the step of further irradiating said first layer at the surface from which said electrode was removed with a light having a frequency above the threshold of said first layer to depolarize the first layer in accordance with said image to be printed producing a negative image.

13. The process of claim 12, further comprising the step of applying said charge carriers to said dielectric platelet prior to positioning on said first layer by corona discharge.

* * * * *